United States Patent [19]

O'Neil

[11] 3,960,383

[45] June 1, 1976

[54] MAGNETIC SKI BINDING

[76] Inventor: Bryan L. O'Neil, General Delivery, West Bridgewater, Vt. 05034

[22] Filed: Aug. 28, 1974

[21] Appl. No.: 501,057

[52] U.S. Cl. ..... 280/612
[51] Int. Cl.[2] ..... A63C 9/08
[58] Field of Search ..... 280/11.35 M

[56] References Cited

UNITED STATES PATENTS

| | | | |
|---|---|---|---|
| 2,276,826 | 3/1942 | Crowther | 280/11.35 M |
| 3,246,907 | 4/1966 | Chisholm | 280/11.35 M |
| 3,332,695 | 7/1967 | Rosenberg | 280/11.35 M |
| 3,353,835 | 11/1967 | Sommer | 280/11.35 M |
| 3,537,719 | 11/1970 | Gottfried | 280/11.35 M |
| 3,667,771 | 6/1972 | Larson | 280/11.35 M |

FOREIGN PATENTS OR APPLICATIONS

| | | | |
|---|---|---|---|
| 2,020,895 | 11/1971 | Germany | 280/11.35 M |

*Primary Examiner*—M. H. Wood, Jr.
*Assistant Examiner*—Milton L. Smith
*Attorney, Agent, or Firm*—Schiller & Pandiscio

[57] ABSTRACT

An improved ski binding assembly includes front and rear magnetic coupling units which are attachable to a ski and boot attachments which coact with the coupling units to hold the boot to the ski. Each coupling unit comprises means for providing an adjustable magnetic field as well as means for providing adjustable pressure relief. The boot attachments include a magnetically sensitive material so that when the ski boot is secured between the units the magnetic field provided by each unit will couple the unit and the adjacent boot attachment as a result of magnetic attraction.

7 Claims, 6 Drawing Figures

MAGNETIC SKI BINDING

The present invention relates to ski binding devices and more particularly to magnetic ski binding devices.

Many ski binding devices which are now commercially available generally comprise a great many parts which mechanically interrelate to secure a ski boot to a ski. One common type of binding includes a mechanical clamp arrangement for fastening the boot to the ski. However, clamp type bindings have one or more disadvantages. Thus, for example, although they offer stress relief which is adjustable, in some instances the stress relief is only provided when torque is applied to the boot in the plane of the ski. Also, in some cases the adjustment for stress relief is difficult to make and frequently is critical or unduly sensitive. Further, these bindings are sometimes difficult to get into and out of, especially when the skier is on a steep slope. Also, adjustable parts of clamp-type bindings can sometimes move out of adjustment when subjected to certain mechanical vibrations. Finally, dirt, ice or snow may impede release of the binding under stress or when the skier wishes to remove his skis.

The primary object of the present invention, therefore, is to provide an improved ski binding device which overcomes at least some of the aforementioned problems of prior art devices.

More specifically, another object of the present invention is to provide a ski binding device which is rugged and durable and has a minimum of parts.

Still another object of the present invention is to provide a ski binding device which is easy to get into and out of with relative ease.

Yet another object of the present invention is to provide a ski binding device which is relatively easy to adjust for boot size, which has relatively few parts which are adjustable, and which can be adjusted without the need for specially designed tools.

And still another object of the present invention is to provide a ski binding device which offers a relatively great degree of stress relief, is not affected by vibrations which occur under normal skiing conditions or ice or snow, is durable and can be made at a relatively low cost.

And yet another object of the present invention is to provide a magnetic ski binding device which includes means for adjusting the magnetic field.

These and other objects are achieved by a ski-binding device which comprises front and rear coupling units which are attachable to a ski and cooperating boot attachments of magnetically sensitive material. Each unit includes magnetic means for providing a magnetic field so that when a ski boot provided with the attachments is positioned between the units, the boot will be secured therein as a result of the magnetic attraction between the boot attachments and the magnetic units. Each unit also includes means for providing adjustable pressure relief so that the boot can easily release from between the units.

Other features and many of the attendant advantages of the invention are described or rendered obvious by the following detailed description which is to be considered together with the accompanying drawings.

In the drawings, like numerals refer to like parts.

Figure 1:
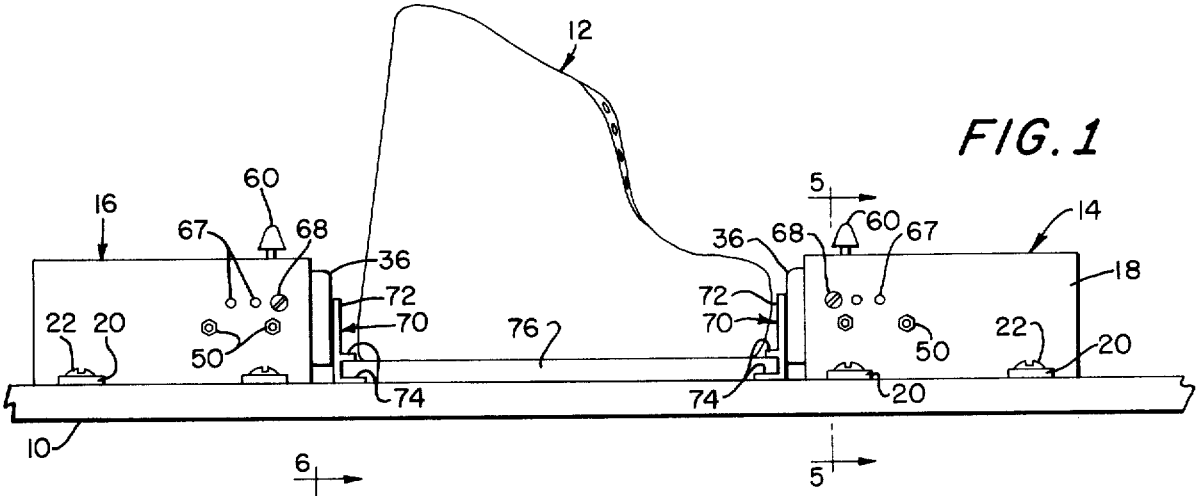
FIG. 1 is a side elevational view of the preferred embodiment assembled for use.

Referring to FIG. 1, the preferred ski binding assembly is shown mounted for use on a ski 10 in order to accommodate and bind in place a ski boot 12. As shown, the size of the ski binding assembly has been exaggerated and enlarged with respect to the ski boot in order to facilitate an understanding of the invention. Generally, the ski binding assembly comprises front and rear magnetic coupling units 14 and 16, respectively. The two units are identical and, thus, for purposes of illustration and ease of understanding, only one unit is shown and described in detail. Each unit comprises a housing 18 which includes side extensions 20 provided with elongate slots 21 in order that the unit may be secured to the ski 10 by suitable means, such as screws 22. The housing is preferably made of a nonmagnetic material, such as aluminum or the like.

Figure 2:
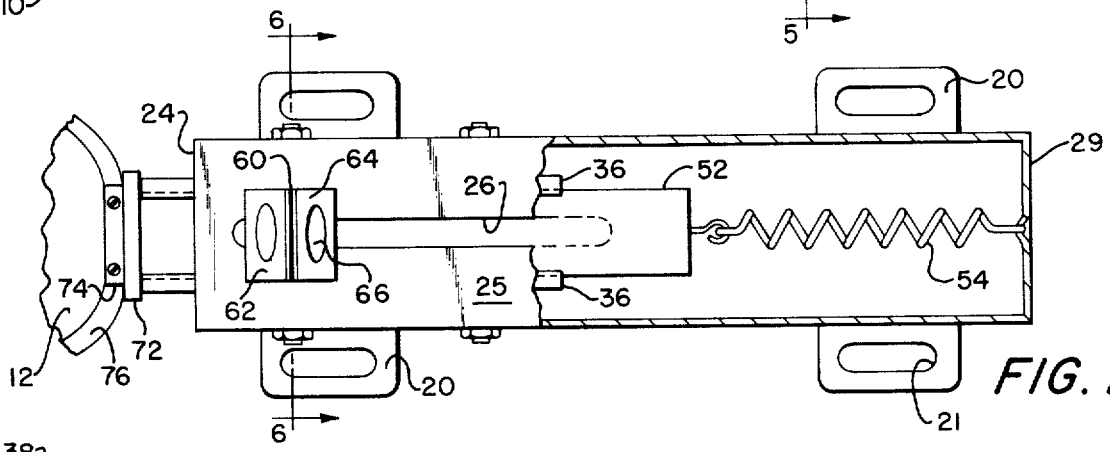
FIG. 2 is an enlarged top view, partly in section, of one of the magnetic coupling units shown in FIG. 1.
Figure 5:
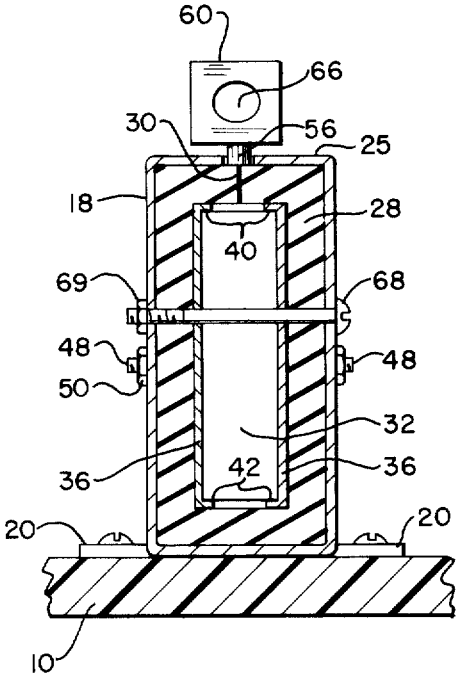
FIG. 5 is a cross-sectional view taken along line 5—5 of FIG. 1.
Figure 6:
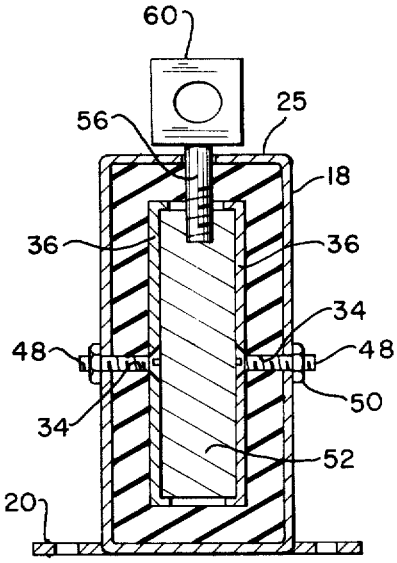
FIG. 6 is a cross-sectional view taken along line 6—6 of FIG. 2.

Referring specifically to FIGS. 2, 5 and 6, the housing 18 of each unit is open at one end and its top surface 25 is provided with a longitudinal slot 26 which extends lengthwise of the ski when the unit is mounted thereon. The inner surfaces of the housing 18 are lined with a cushion material 28 which is resiliently deformable and magnetically insulating. Preferably also material 28 is moisture impermeable. The material 28 may be made of anyone of several polymeric materials, such as natural or synthetic rubber, polyurethane or the like. A slit 30 is provided in material 28 in alignment with slot 26 of the housing, the purpose of which will become more apparent hereinafter. Material 28 may, but need not, line the end wall 29 of the housing. The housing 18 and material 28 thus form a cavity 32, the shape of which is preferably of a rectangular cross-section, and is open at the end 24. The housing 18 and material 28 are also provided on both sides with two horizontally aligned holes 34 to receive bolts 48. The holes 34 in housing 18 preferably are slightly oversized with respect to the shanks of bolts 48 so that the latter can undergo a limited angular motion relative to the housing.

A pair of flat or planar pole pieces 36 are disposed in cavity 32 adjacent to the inner opposite side surfaces of material 28, and the front ends of both pole pieces project out of the open end 24 of the housing 18 a predetermined distance. The poles are made of any material which exhibits small magnetic losses, and has a relatively permeability greater than unity, such as any of the ferromagnetic materials. Typically, the pole pieces are made of soft iron. The upper corner of the front end of each pole piece 36 is rounded as shown at 38 for a reason which will become more evident hereinafter.

Figure 3:
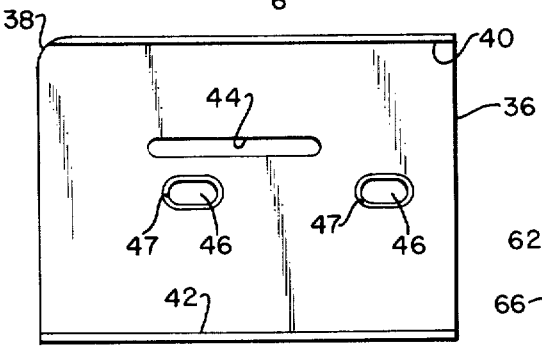
FIG. 3 is an enlarged side elevational view of a magnetic pole piece of one of the magnetic coupling units.
Figure 4:
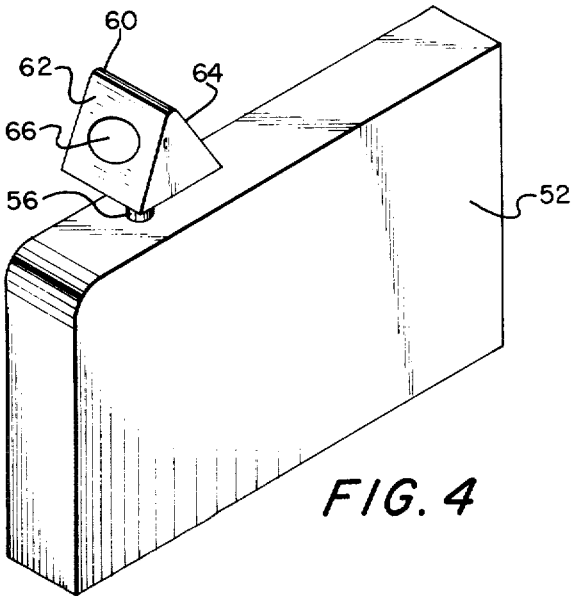
FIG. 4 is an enlarged perspective view of the magnet of one of the magnetic coupling units.

As shown in FIG. 3, each pole piece is provided with flanges 40 and 42 along its upper and lower edges respectively which extend in toward the cavity 32 of the pole piece. Each pole piece also includes an elongated slot 44 and two smaller elongate holes 46. The axis of elongation of each of the slots 44 and holes 46 is disposed parallel to the flanges 40 and 42. The inner edge of each hole 46 is bevelled as shown at 47 so that suitable means, such as bolts 48, may be used to secure the pole pieces in place in the cavity 32. Referring to FIG. 6, the bolts 48 are sized so that the head of each will be restrained from passing through the bevelled slot 46 and will be flush with the inner surface of the pole piece, while the shaft of the bolt extends through the material 28 and the housing 18. Since the slots 46 are oval, they are oversized with respect to the bolts 48 lengthwise of the pole piece for reasons which will become more evident hereinafter. Each bolt is secured in place by a nut 50. By tightening the nuts 50, the bolts 48 will force the associated pole piece toward the adjacent wall of the housing against the biasing effects of cushion material 28. Since two sets of bolts and nuts are used for each pole piece, the distance between the two pole pieces can be varied while maintaining the two substantially in a parallel relationship.

A permanent magnet 52, which is positioned in the cavity 32 and sized to just fit between the flanges 40 and 42 of the two pole pieces, frictionally engages the inner surfaces of the two pole pieces. By adjusting the nuts 50, the force required to move the magnet in a direction parallel to the inner surfaces of the pole pieces against the frictional forces exerted by the pole pieces can be varied. The magnet 52 can be made of any material which is capable of being permanently magnetized, and preferably includes samarian cobalt. Preferably but not necessarily, the magnet is spring biased within the housing 18 by means of a coiled tension spring 54. The latter is attached at one end to the magnet 52 and at its other end to the wall of housing 18 opposite open end 24. The spring constant of the spring 54 is such that it will provide a sufficient amount of force to overcome the frictional forces exerted on the magnet by the pole pieces and to draw the magnet toward wall 29 when no boot attachment is engaged with the pole pieces.

In order to move each magnet with respect to the pole pieces, each magnet is provided with a release lever 56 which, as shown in FIG. 6, may be screw threaded into a tapped hole in the top surface of the magnet 52. The upper end of the lever includes a knob portion 60. The lever is preferably in the form of a rod of circular cross-section and projects up through the slit 30 of the material 28 and the slot 26 of the housing 18. The knob portion 60 is preferably shaped to have two top surfaces 62 and 64 which are inclined with respect to one another and are oriented so that the upper and lower horizontal edges of inclined surfaces 62 and 64 are at a right angle to the plane of magnet 52. Knob portion 60 is preferably spaced slightly from the upper surface 25 of the housing so as to prevent it from binding against the housing. Each of the inclined surface 62 and 64 is provided with a depression or blind hole 66, the purpose of which will be explained in greater detail in connection with the operation of the invention. When sufficient force is exerted on the lever lengthwise of the housing to counteract the frictional forces exerted between the pole pieces and the magnet, the latter will slide in a horizontal direction in the cavity 32. Since the vertical dimension of the magnet is made only slightly less than the distance between the upper and lower flanges 40 and 42 of each of the pole pieces, the magnet is restrained against any vertical movement with respect to the pole pieces.

For reasons which will become more apparent hereinafter, means are provided for adjustably determining the closest position the magnet can be moved toward the open end 24 of the housing 18. The means preferably includes a plurality of holes 67 on each side of the housing and a bolt 68 which extends through one of the holes 67 on one side of the housing 18, through the slot 44 of one pole piece, across cavity 32 in front of the magnet, through the slot 44 of the other pole piece and out of a corresponding hole 67 on the opposite side of the housing. Bolt 68 intercepts the magnet when it is moved toward the open end 24 of the housing and thus determines the extent to which the magnet can be moved toward the open end 24. This limit position of the magnet can be altered by locating bolt 68 in one of the other holes 67. Bolt 68 preferably is made of a non-magnetic material but a steel bolt also may be used. A nut 69 holds bolt 68 in place.

The units 14 and 16 described are attached to the ski 10 so that they are substantially aligned with one another and with their open ends confronting one another. The distance between the two units 14 and 16 is dependent on the size of the boot which is to be used with the bindings. As shown in FIG. 1, the units are spaced (measured from the extending edges of the pole pieces 36) at a distance slightly in excess of the length of boot 12.

The boot 12 is equipped with means for magnetically coupling the boot to the pole pieces. Preferably, the magnetic coupling means comprises two identical attachments 70, each made of a ferromagnetic material, which are secured to the front and rear ends of the boot 12. Generally, each attachment comprises a planar vertical portion 72 which is adapted to physically contact the pole pieces and two vertically spaced horizontal sections 74 which extend out from one side of the vertical portion and are adapted to accommodate the front or rear portion of the sole 76 of the boot by sandwiching the sole therebetween. The attachments are secured in place by suitable fasteners such as screws (not shown) which extend through holes (also not shown) provided in the horizontal sections 74 of the attachments and are anchored in the sole 76.

The units 14 and 16 are spaced from one another so that when the boot is inserted between them, the heel and toe attachments 70 will lightly contact the pole pieces of both units, or engage the pole pieces of one unit and be spaced only slightly away from the pole pieces of the other unit. It should be appreciated that the rounded corner edge 38 as well as the give and take of the pole pieces provided by the oversizing of slots 46 of the pole pieces helps facilitate the reception of the boot 12 and attachments 70. Further, the pole pieces can give slightly side to side when the boot is being inserted since the resilient material 28 in the housing 18 will compress when any portion of a pole piece is pressed against it as a result of any stresses placed thereon. Additional limited play of the pole pieces is achieved if holes 34 are made oversized with respect to the shanks of bolts 48 as previously described.

The strength of the magnetic field between the attachments 70 and the pole pieces 36 is dependent on the position of the magnet 52. The longer the magnetic path, the weaker the field will be between each attachment 70 and the adjacent pole pieces 36. When the boot is in place so that the attachments 70 lightly contact or lie close to the pole pieces 36, a magnetic circuit is provided whereby the flux path extends from each magnet through one pole piece, through the attachment 70, through the other pole piece and back to the magnet 52. Thus, by moving the magnet relative to the pole pieces and the attachment 70, the strength of the magnetic field through the attachments 70 can be varied. When the magnet is moved away from the open end 24 of housing 18, for example, the magnetic field through the associated boot attachment is diminished. The magnetic coupling acts to draw the magnet toward the adjacent boot attachment in opposition to the force exerted by spring 54. This magnetic coupling can be terminated by forcing release knob 56 away from the open end 24 of housing 18. It is noted that the skier can push the release knob 60 by hand, or more conveniently by inserting the end of his ski pole (not shown) in the opening 66 of the release knob and pushing on the ski pole.

In the illustrated embodiment, the maximum field strength through the boot attachment provided by the magnet is dependent on the position of the bolt 68. Where a strong field is desired to assure a strong coupling as where the user is an expert skier, the bolt 68 is attached through the hole 67 closest to the open end of housing 18. If however ready release from the binding is desired, as for example when a novice skier is using the binding, the bolt 68 can be positioned through a different hole 67 located further from the open end of housing 18. If bolt 68 is removed, the maximum forward position of the magnet is determined by engagement of lever 56 with that end of slot 26 which is nearest the open end 24 of the housing.

The release force of the binding assembly can be also adjusted by adjusting the bolts and nuts 48 and 50 so that the pole pieces are drawn away from or allowed to move closer to the magnet. In this connection it is to be noted that the movable pole pieces and the cushion material 28 coact to absorb mechanical vibrations and minor sudden shock forces without allowing the boot to come free from the ski under normal use. However, if the boot is subjected to substantial torque or a large force tending to separate it from the ski, the magnetic coupling will allow the boot to come free if the torque or other force is great enough. At such time, the pole pieces can yield by movement relative to the housing and magnet to reduce the friction forces between them and the boot attachments and thereby facilitate disengagement of the boot from the ski. Once the boot is pulled free, spring 54 will pull the magnet away from the open end 24 of the housing 18 and thereby reduce the magnetic field strength at the ends of the pole pieces. As a consequence, reentry of the boot between the two coupling units can be accomplished with little effort required to overcome the strength of the field in positioning the boot properly between the two coupling units.

The ski binding assembly thus described offers the advantage that it is adjustable to provide a coupling force that is suitable according to the weight, ability and style of the skier. The assembly also provides boot release in various directions without need for overcoming any spring tension or use of any cams or toggle levers. It is significant to note also that the front unit 14 can be adjusted to release more easily than the rear unit 16. A further advantage is that resilient material 28 will absorb and thus cushion mechanical vibrations of the magnitude and frequency encountered in normal skiing, with the result that the binding assembly is not unduly sensitive and will not release except when necessary.

Certain obvious changes may be made in the illustrated embodiment of the device without departing from the scope of the invention. Thus, for example, the magnet need not be flat but could be a cylinder and the two flat pole pieces could be replaced by two concentric cylindrical members of magnetically sensitive material with the magnet slidably interposed between them so as to form a concentric array. Also spring 54 could be omitted and the pole pieces could be cemented to the cushion material and the latter cemented to the housing instead of being held by bolts 48. Accordingly, it is intended that all matter contained herein be interpreted as illustrative and not in a limiting sense.

What is claimed is:

1. A ski binding unit for binding a ski to a ski boot that is equipped with magnetically conductive means, said unit comprising:

a housing having first and second ends and means for attaching said housing to said ski so that said first and second ends are aligned lengthwise of said ski;

two magnetically conductive pole pieces disposed within and mounted to said housing so that an end surface of each pole piece projects out of said first end of said housing for engagement by said ski boot;

a permanent magnet disposed within said housing between and proximate to said pole pieces so as to induce a magnetic field in said pole pieces for magnetically binding said magnetically conductive means to said pole piece end surfaces;

said magnet being movable relative to said housing and said pole pieces so as to permit adjustment of the intensity of the magnetic field at said pole piece end surfaces; and means for moving said magnet relative to said housing and said pole pieces.

2. A unit according to claim 1 wherein said housing is made of a non-magnetic material.

3. A unit according to claim 1 further including means resiliently coupling said pole pieces to said housing.

4. A unit according to claim 1 further including vibration damping means disposed between said pole pieces and said housing.

5. A unit according to claim 1 wherein said last-mentioned means is accessible from the outside of said housing for moving said magnet relative to said pole pieces.

6. A unit according to claim 1 including means for moving said pole pieces toward and away from said housing.

7. A ski binding assembly for binding a ski to a ski boot, said assembly comprising (1) magnetically conductive means attachable to the toe and heel ends of said ski boot and (2) a pair of binding units attachable to said ski, each of said binding units including:

a housing having first and second ends and means for attaching said housing to said ski so that said first and second ends are aligned lengthwise of said ski;

means for attaching said housing to said ski;

two magnetically conductive pole pieces disposed within and mounted to said housing so that an end surface of each pole piece projects out of said first end of said housing for engagement by said ski boot;

a permanent magnet disposed within said housing between and proximate to said pole pieces so as to induce a magnetic field in said pole pieces for magnetically binding said magnetically conductive means to said pole piece end surfaces;

said magnet being movable relative to said housing and said pole pieces so as to permit adjustment of the intensity of the magnetic field at said pole piece end surfaces; and means for moving said magnet relative to said housing and said pole pieces.

* * * * *